US011138945B2

(12) United States Patent
Huang et al.

(10) Patent No.: US 11,138,945 B2
(45) Date of Patent: Oct. 5, 2021

(54) SOURCE DRIVER MODULE, DISPLAY DEVICE, METHOD FOR DRIVING A DISPLAY PANEL AND METHOD FOR DRIVING A DISPLAY DEVICE

(71) Applicant: AU Optronics Corporation, Hsin-Chu (TW)

(72) Inventors: Jie-Chuan Huang, Hsin-Chu (TW); Chun-Wei Chang, Hsin-Chu (TW); Chia-Ming Wu, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 16/879,306

(22) Filed: May 20, 2020

(65) Prior Publication Data

US 2021/0027732 A1 Jan. 28, 2021

(30) Foreign Application Priority Data

Jul. 23, 2019 (TW) ..... 108126021

(51) Int. Cl.
*G09G 3/36* (2006.01)

(52) U.S. Cl.
CPC ..... *G09G 3/3648* (2013.01); *G09G 3/3685* (2013.01); *G09G 2310/08* (2013.01)

(58) Field of Classification Search
None
See application file for complete search history.

(56) References Cited

U.S. PATENT DOCUMENTS 10,706,756 B2 7/2020 Lin et al.
2012/0154259 A1* 6/2012 Kim ..... G09G 3/3291 307/108
2016/0078813 A1* 3/2016 Mizukoshi ..... G09G 3/3291 345/76
2020/0074902 A1 3/2020 Lin et al.

FOREIGN PATENT DOCUMENTS

CN 109461420 A 3/2019

OTHER PUBLICATIONS

CNIPA has issued the Office Action for the corresponding China application dated Apr. 30, 2021.

* cited by examiner

*Primary Examiner* — Aneeta Yodichkas
(74) *Attorney, Agent, or Firm* — WPAT, PC

(57) ABSTRACT

The present disclosure provides a source driver module for driving a display panel. The source drive module includes a source driver circuit, a first conductive wire and a first switch unit. The first conductive wire is electrically connected to the source driver circuit. The first switch unit is connected between the first conductive wire and a first data line of the display panel to conduct current therebetween during a first data outputting period and a second data outputting period, and to interrupt current therebetween during a first switch-off period connecting the first data outputting period and the second data outputting period. The source driver circuit outputs a first voltage signal during the first data outputting period and the first switch-off period; it outputs a second voltage signal during the second data outputting period; and it outputs the first voltage signal during the first switch-off period.

9 Claims, 9 Drawing Sheets

SOURCE DRIVER MODULE, DISPLAY DEVICE, METHOD FOR DRIVING A DISPLAY PANEL AND METHOD FOR DRIVING A DISPLAY DEVICE

BACKGROUND OF THE INVENTION

1. Field of the Invention

The present disclosure relates to a display panel driver module and method; in particular, it relates to a source driver module, display device, method for driving a display panel and method for driving a display device to reduce panel noise.

2. Description of the Prior Art

In the structure of a liquid crystal display of current technology, a multiplexer (MUX) is usually disposed between a panel and a source driver circuit, configured to receive pixel voltage outputted by the source driver circuit and to provide the pixel voltage to a data line of the panel by time-division so as to drive pixels. However, when outputting two different pixel signals consecutively to the same pixel, and the signal receiving end of the multiplexer is electrically connected to the source driver circuit, charge sharing phenomenon occurs easily due to the voltage difference between the two signals, resulting in the generation of internal noise in the panel. Therefore, the source drivers of current technology still have rooms for improvement.

SUMMARY OF THE INVENTION

As mentioned above, one of the purposes of the present invention is to provide a source driver module, display device, method for driving a display panel and method for driving a display device so as to reduce the noise in the display panel to compensate the shortcoming of the current art.

One of the technical solutions adopted in the embodiments of the present disclosure provides a source driver module for driving a display panel. The source driver module includes a source driver circuit, a first conductive wire and a first switch unit. The first conductive wire is electrically connected to the source driver circuit and configured to output the signals of the source driver circuit. The first switch unit is connected between the first conductive wire and a first data line of the display panel. The first switch unit is configured to conduct current between the source driver circuit and the first data line during a first data outputting period and a second data outputting period after the first data outputting period, and to interrupt current between the source driver circuit and the first data line during a first switch-off period between the first data outputting period and the second data outputting period. The source driver circuit is configured to output a first voltage signal to the first data line through the first conductive wire and the first switch unit during the first data outputting period, to output a second voltage signal to the first data line through the first conductive wire and the first switch unit during the second data outputting period, and to output the first voltage signal to the first conductive wire during the first switch-off period so that the first conductive wire and the first data line have the same voltage level when switching to the second data outputting period from the first switch-off period.

Another embodiment of the present disclosure provides a display panel driving method for the source driver module, including: the source driver circuit outputting the first voltage signal to the first data line through the first conductive wire and the first switch unit during the first data outputting period; and, the source driver circuit outputting the first voltage signal to the first conductive wire during the first switch-off period so that the first conductive wire and the first data line have the same voltage level when switching to the second data outputting period from the first switch-off period.

Another embodiment of the present disclosure provides a display device which includes a display panel, a source driver module, and a timing controller. The timing controller includes a first storage unit and a second storage unit. The first storage unit and the second storage unit are electrically connected to the source driver circuit, respectively, and the first storage unit and the second storage unit store the first voltage signal and the second voltage signal. The source driver circuit is configured to receive the first voltage signal from the first storage unit of the timing controller and output the first voltage signal to the first data line through the first conductive wire and the first switch unit during the first data outputting period. The source driver circuit is configured to receive the first voltage signal from the second storage unit and output the first voltage signal to the first conductive wire during the first switch-off period. The source driver circuit is configured to receive the second voltage signal from the first storage unit of the timing controller and output the second voltage signal to the first data line through the first conductive wire and the first switch unit during the second data outputting period.

Another embodiment of the present disclosure provides a display device driving method for the display device. The display device driving method includes: storing the first voltage signal and the second voltage signal in the first storage unit and the second storage unit; the source driver circuit receiving the first voltage signal from the first storage unit of the timing controller and outputting the first voltage signal to the first data line through the first conductive wire and the first switch unit during the first data outputting period; and the source driver circuit receiving the first voltage signal from the second storage unit during the first switch-off period so that the first conductive wire and the first data line have the same voltage level when switching to the second data outputting period from the first switch-off period.

DETAILED DESCRIPTION OF THE PREFERRED EMBODIMENT

The source driver module, the display panel driving method, the display device and the display device driving method according to the present disclosure will be described in detail below through embodiments and with reference to FIG. 1 to FIG. 5. A person having ordinary skill in the art may understand the advantages and effects of the present disclosure through the contents disclosed in the present specification. However, the contents shown in the following sentences never limit the scope of the present disclosure. Without departing from the conception principles of the present invention, a person having ordinary skill in the present art may realize the present disclosure through other embodiments based on different views and applications.

In the attached FIGS., for the purpose of clarification, the thicknesses of layers, films, panels, regions and the like are amplified. In the whole specification, the same marks represent the same element. It should be understood that, when an element such as a layer, a film, a panel, a region or a substrate are described as "being on" or "being connected to" another element, they may be directly on or connected to another element, or there may be other elements therebetween. On the other hand, when an element is described as "directly existing on another element" or "directly connecting to another element", there is no element therebetween. As used in the present specification, a "connection" may be a physical and/or electrical connection. In addition, an "electrical connection" or "coupling" means that other elements may exist therebetween.

It should be understood that, even though the terms such as "first", "second", "third" may be used to describe an element, a part, a region, a layer and/or a portion in the present specification, but these elements, parts, regions, layers and/or portions are not limited by such terms. Such terms are merely used to differentiate an element, a part, a region, a layer and/or a portion from another element, part, region, layer and/or portion. Therefore, in the following discussions, a first element, portion, region, layer or portion may be called a second element, portion, region, layer or portion, and do not depart from the teaching of the present disclosure.

If not defined specifically, all terms in the specifications (including terms about technology and science) have the same meaning as those understood by those who have ordinal skill in the art. It should be further understood that, for example, the terms defined in commonly used dictionaries should be interpreted as having a meaning that is consistent with their meaning in the context of the relevant art and the present disclosure, and should not be interpreted in an idealized or overly formal sense unless expressly so defined herein.

The First Embodiment

Figure 1:
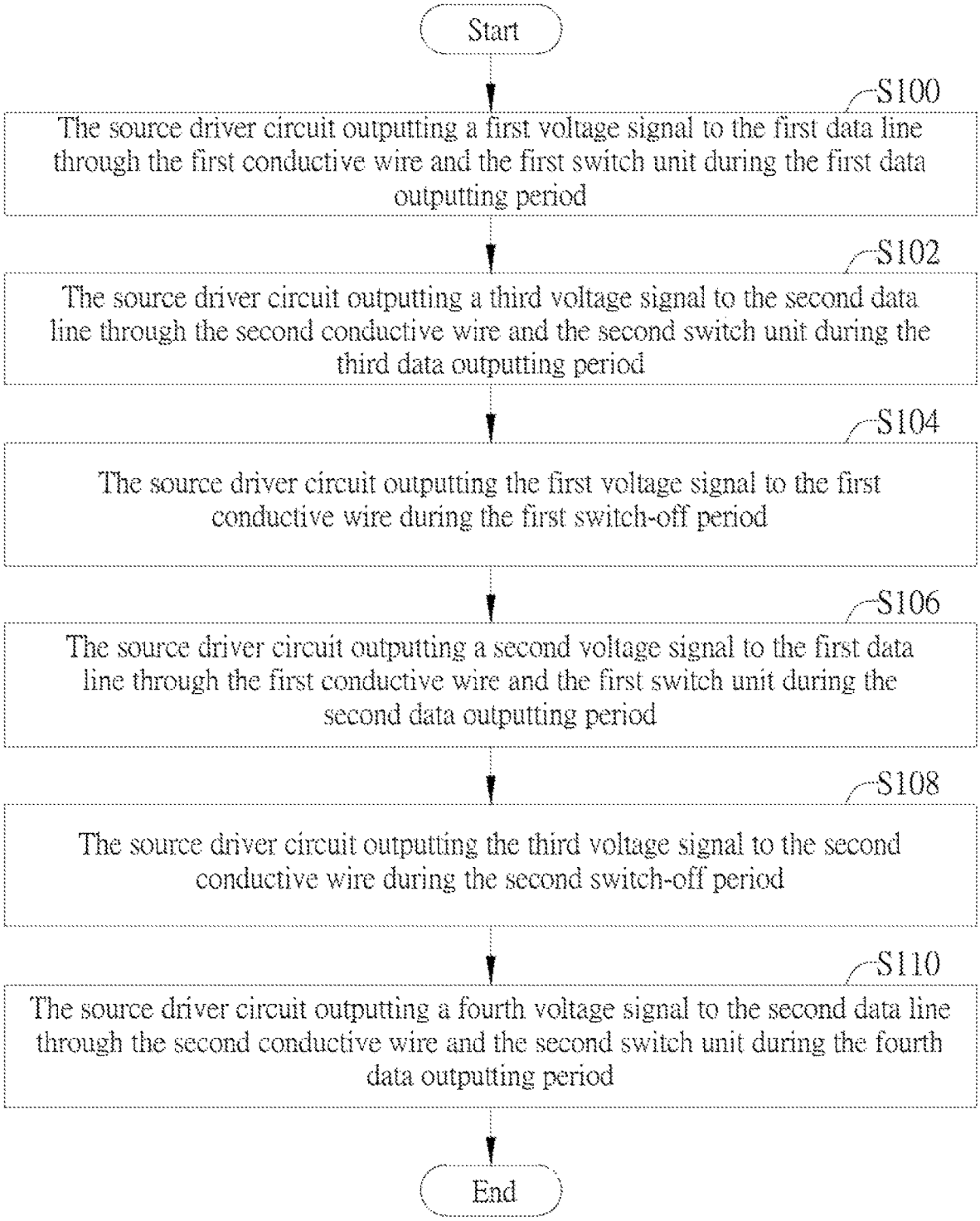
FIG. 1 is a flowchart of a method for driving the display panel in the first embodiment of the present disclosure.
Figure 2A:
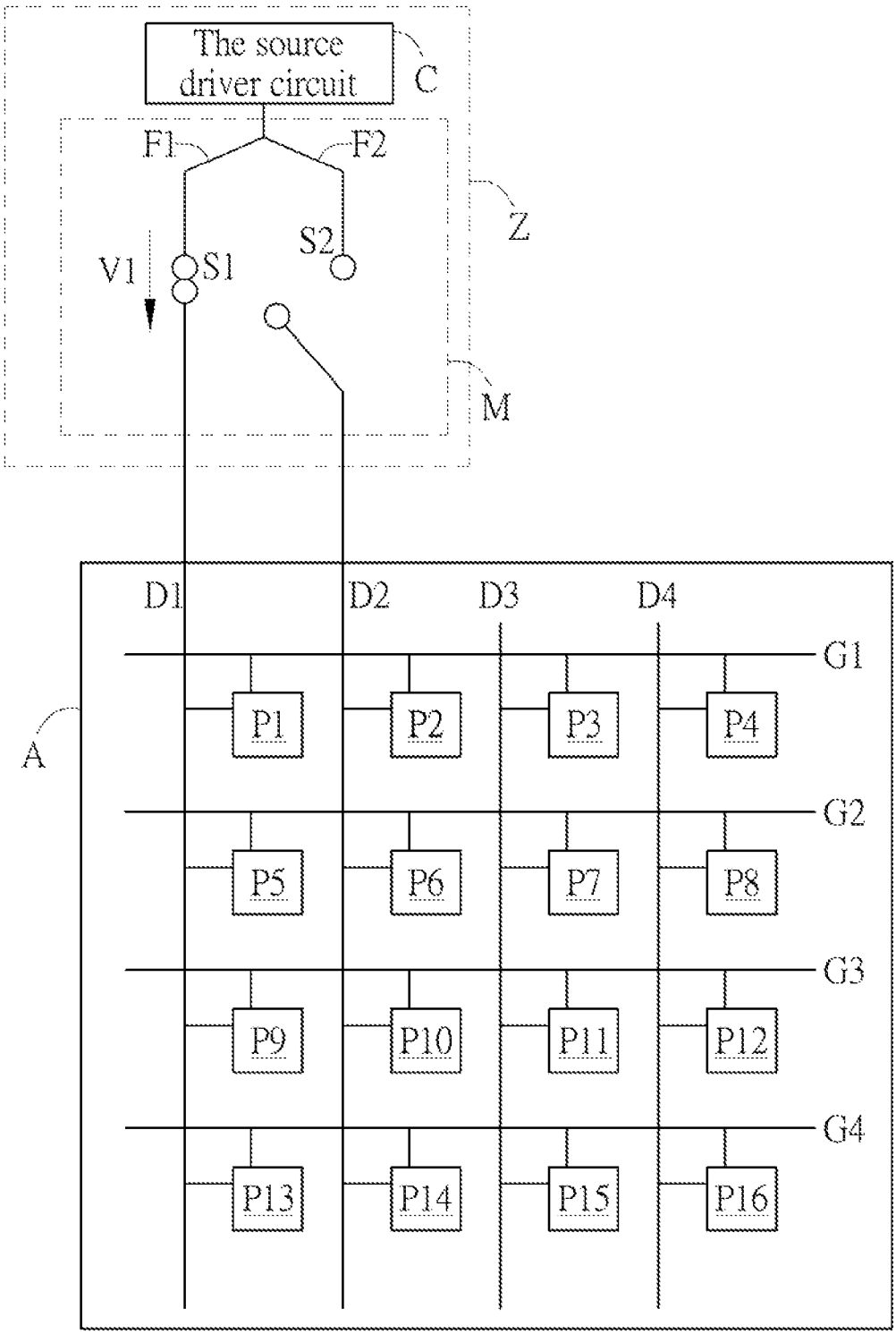
FIG. 2A is a diagram of the source driver module in the first embodiment of the present disclosure implemented according to the step S100 in FIG. 1.

A source driver module Z provided by the first embodiment of the present disclosure and a display panel driving method are described with reference to FIG. 1 to FIG. 2G in the following paragraphs. Firstly, please refer to FIG. 1 and FIG. 2A. FIG. 1 illustrates a flowchart of the display device driving method provided by the first embodiment of the present disclosure. The method uses the source driver module Z illustrated in FIG. 2A. In the present embodiment, a source driver circuit C is configured to input a pixel voltage to a first pixel P1 through a first conductive wire F1 and a first switch unit S1 and to a second pixel P2 through a second conductive wire F2 and a second switch unit S2 alternatingly. As shown in FIG. 2A, the second pixel P2 is driven by a second data line D2 and a first gate line G1. The second switch unit S2 and the first switch unit S1 together form a multiplexer M; however, the present invention is not limited thereto. In another embodiment, the first switch unit S1 and the second switch unit S2 may be respectively coupled to the source driver module Z so as to be independently switched on or off.

Furthermore, please refer to FIG. 2A. The second conductive wire F2 is electrically connected to the source driver circuit C and configured to output the signal of the source driver circuit C. The second switch unit S2 is electrically connected between the second conductive wire F2 and the second data line D2 of the display panel A. The second switch unit S2 is configured to conduct current between the source driver circuit C and the second data line D2 during the third data outputting period T3 and the fourth data outputting period T4, and to interrupt the current between the source driver circuit C and the second data line D2 during the second switch-off period B2. Specifically, the third data outputting period T3 is between the first data outputting period T1 and the first switch-off period B1; the fourth data outputting period T4 is after the second data outputting period T2; and the second switch-off period B2 is between the second data outputting period T2 and the fourth data outputting period T4.

More specifically, according to the order of occurrence, the periods are ordered as follows: the first data outputting period T1, the third data outputting period T3, the first switch-off period B1, the second data outputting period T2, the second switch-off period B2, and the fourth data outputting period T4, wherein each period occurs right after its preceding period. In addition, the first switch-off period B1 and the second switch-off period B2 are the time intervals between the periods of time when the source driver circuit C outputs the pixel data to the two data lines D1 and D2 of the display panel A. Generally speaking, a high impedance status is kept between the source driver circuit and the display device in between the periods of time the source driver circuit outputs the pixel data to the two data lines. At that time, the electrical connection between the source driver circuit and the display device is interrupted (For example, interrupting the electrical connection by disposing the multiplexer, but not limited thereto). During the period of high impedance, the source driver circuit does not input the pixel voltage to the pixel unit. When switching to outputting the pixel data to the next data line, the electrical connection between the source driver circuit and the display device is restored, for example, by a multiplexer. In the present embodiment, the same pixel voltage, which has a voltage level the same as the corresponding data line, is outputted to the first conductive wire F1 and the second conductive wire F2 during the aforementioned time interval so as to avoid generating charge sharing, which further generates noises, due to different voltages between the first conductive wire F1 or the second conductive wire F2 and the data line D1 when outputting the next data to the same data line.

Please refer to FIG. 1 and FIG. 2A to FIG. 2F, wherein FIG. 2A to FIG. 2F respectively correspond to the steps S100, S102, S104, S106, S108, and S110 in FIG. 1. As shown in FIG. 1, the present embodiment further provides a display panel driving method for the source driver module Z illustrated in FIG. 2A, which includes the step S100: the source driver circuit C outputting a first voltage signal V1 to the first data line D1 through the first conductive wire F1 and the first switch unit S1 during the first data outputting period T1; the step S102: the source driver circuit C outputting a third voltage signal V3 to the second data line D2 through the second conductive wire F2 and the second switch unit S2 during the third data outputting period T3; the step S104: the source driver circuit C outputting the first voltage signal V1 to the first conductive wire F1 during the first switch-off period B1; the step S106: the source driver circuit C outputting a second voltage signal V2 to the first data line D1 through the first conductive wire F1 and the first switch unit S1 during the second data outputting period T2; the step S108: the source driver circuit C outputting the third voltage signal V3 to the second conductive wire F2 during the second switch-off period B2; and the step S110: the source driver circuit C outputting a fourth voltage signal V4 to the second data line D2 through the second conductive wire F2 and the second switch unit S2 during the fourth data outputting period T4.

The source driver circuit C in the present embodiment inputs the pixel voltage signal to the first data line D1 and the second data line D2 alternatingly. However, the present disclosure is not limited thereto. In another embodiment, the order of output to the first data line D1 and the second data line D2 may be interchanged. For example, the output sequence of the source driver circuit C may be as follows: the first data line D1, the second data line D2, the second data line D2, the first data line D1, the first data line D1, the second data line D2 . . . and the like.

Figure 2B:
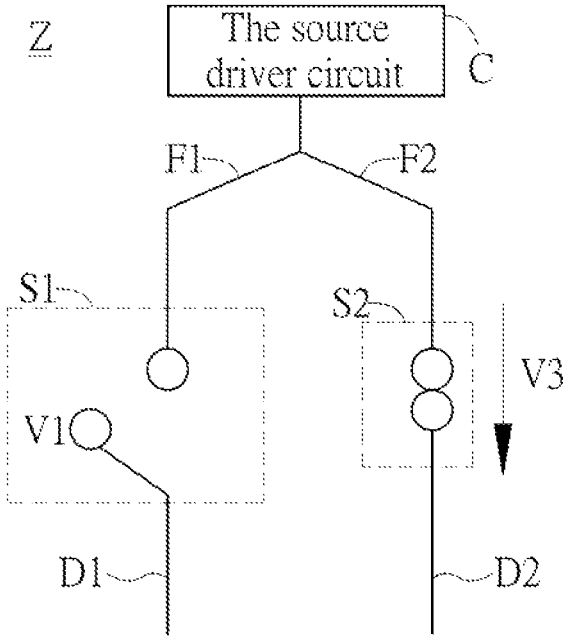
FIG. 2B is a partial schematic diagram of the source driver module in the first embodiment of the present disclosure implemented according to the step S102 in FIG. 1.

As shown in FIG. 2A, in the step S100, the first switch unit S1 conducts current, and the source driver circuit C outputs the first voltage signal V1 to the first data line D1. Then, in the step S102, the source driver module Z enters the third data outputting period T3. As shown in FIG. 2B, the first switch unit S1 interrupts the current and the second switch unit S2 conducts the current. At the same time, the source driver circuit C outputs the third voltage signal V3 to the second data line D2, and the end of the first switch unit S1 coupled to the first data line D1 maintains the voltage level of the first voltage signal V1.

Figure 2C:
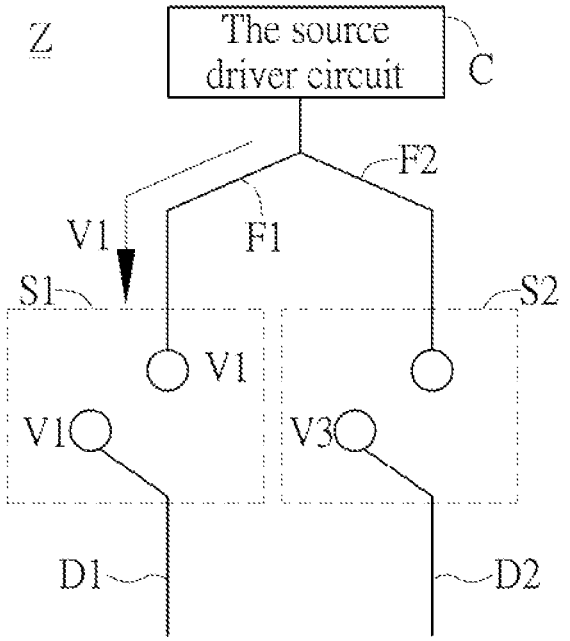
FIG. 2C is a partial schematic diagram of the source driver module in the first embodiment of the present disclosure implemented according to the step S104 in FIG. 1.

Please refer to FIG. 2C, corresponding to the step S104. During the first switch-off period B1 after the third data outputting period T3, in order to not have a voltage difference between the first conductive wire F1 and the first switch unit S1 when the first switch unit S1 returns to a conducting state during the second data outputting period T2 so as to avoid charge sharing, the source driver circuit C outputs the first voltage signal V1 to the first conductive wire F1. Thus, it is possible to have the same voltage level at the end of the first conductive wire F1 and the end of the first switch unit S1 connected to the first data line D1 so that the first conductive wire F1 and the first data line D1 have the same voltage level when entering the second data outputting period T2 from the first switch-off period B1. In addition, the second switch unit S2 also interrupts the current, and one end of the second switch unit S2 coupled to the second data line D2 maintains the voltage level of the third voltage signal V3 during the first switch-off period B1.

Figure 2D:
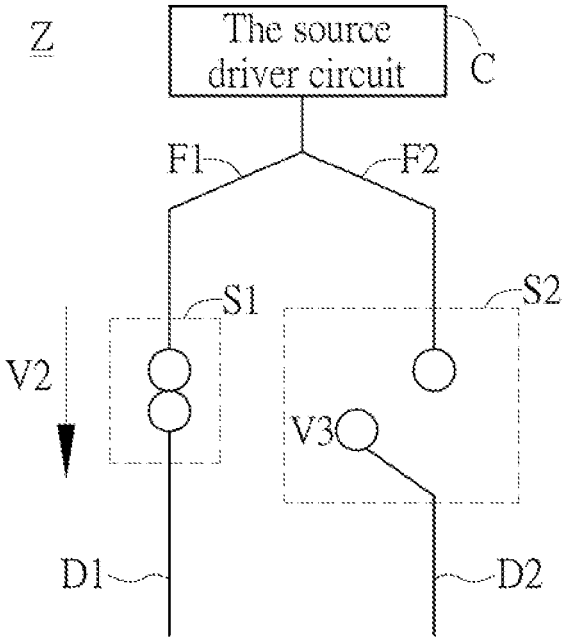
FIG. 2D is a partial schematic diagram of the source driver module in the first embodiment of the present disclosure implemented according to the step S106 in FIG. 1.

FIG. 2D corresponds to the step S106, wherein the source driver module Z enters the second data outputting period T2, and the first switch unit S1 conducts current. The source driver circuit C outputs the second voltage signal V2 to the first data line D1 at that time.

Figure 2E:
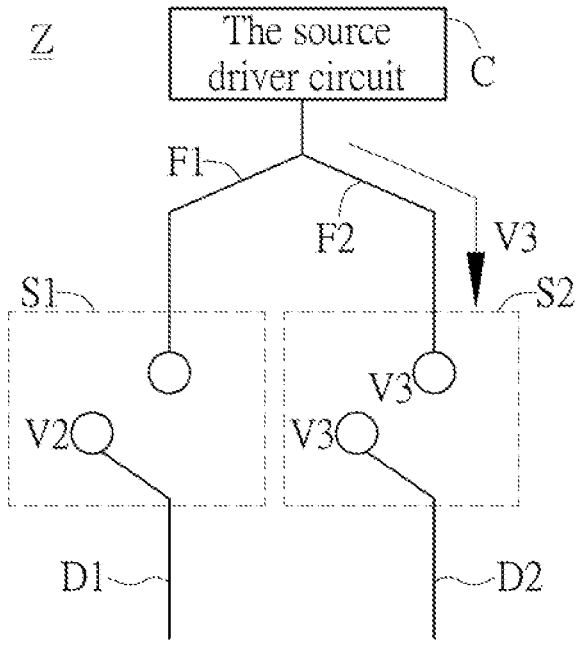
FIG. 2E is a partial schematic diagram of the source driver module in the first embodiment of the present disclosure implemented according to the step S108 in FIG. 1.
Figure 2F:
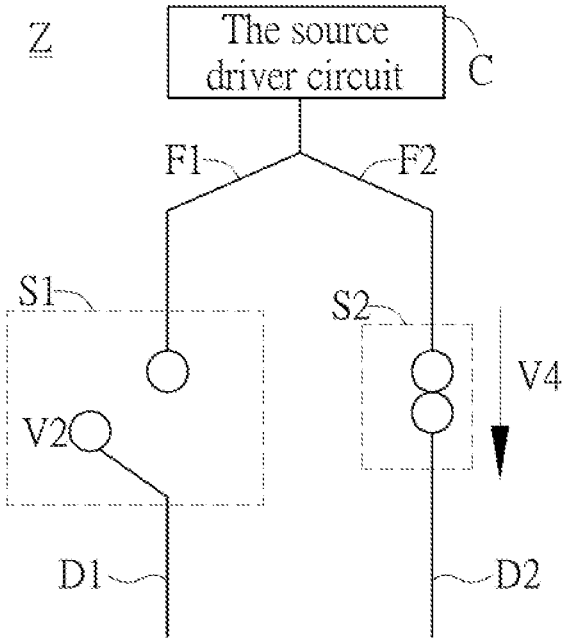
FIG. 2F is a partial schematic diagram of the source driver module in the first embodiment of the present disclosure implemented according to the step S110 in FIG. 1.

Then, as shown in FIG. 2E, in the step S108, the source driver module Z enters the second switch-off period B2, and the first switch unit S1 interrupts current. At that time, to avoid having a voltage difference between the second conductive wire F2 and the second switch unit S2 when the second switch unit S2 returns to a conducting state during the fourth data outputting period T4, the source driver circuit C outputs the third voltage signal V3 to the second conductive wire F2 so that the second conductive wire F2 and the second data line D2 have the same voltage level when entering the fourth data outputting period T4 from the second switch-off period B2. Therefore, noise due to the voltage difference between the second conductive wire F2 and the second switch unit S2 will not be generated when the second switch unit S2 conducts current and transmits a fourth voltage signal V4 in the step S110 (please refer to FIG. 2F).

Figure 2G:
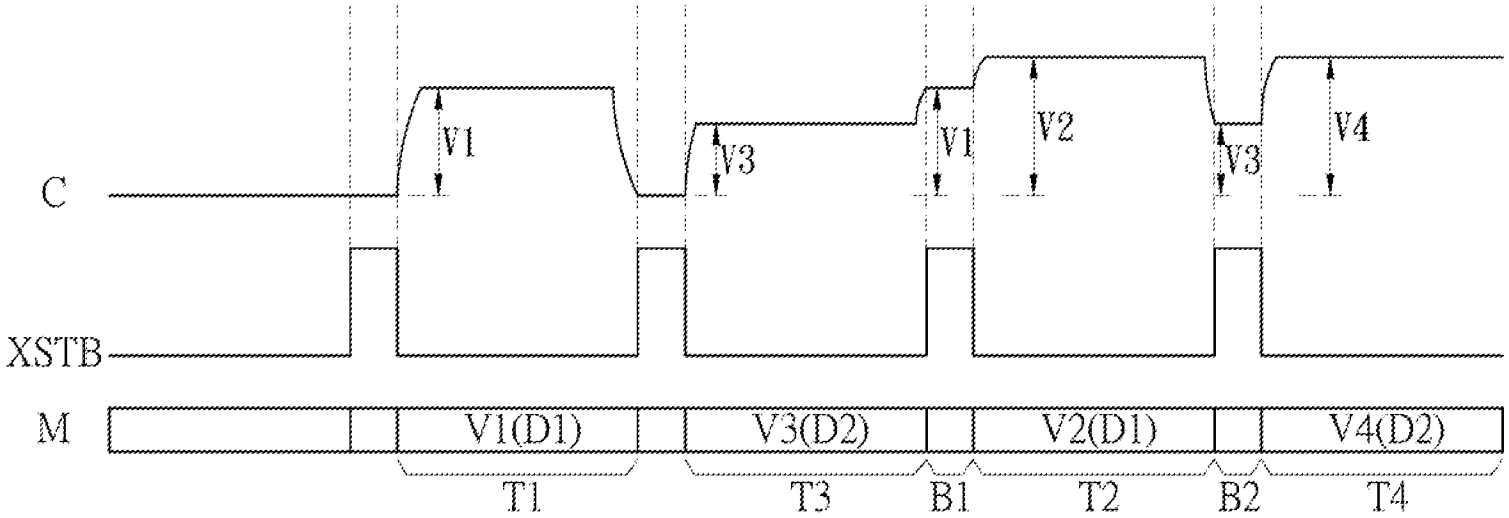
FIG. 2G is a waveform generated when the source driver module in the first embodiment of the present disclosure is implemented according to each of the steps in FIG. 1.

FIG. 2G is a waveform generated by the source driver module Z of the present embodiment implemented according to each of the steps in FIG. 1. The present embodiment is described from the perspective of signal waveform with reference to FIG. 2G and the flowchart of FIG. 1. In FIG. 2G, the C waveform represents the waveform outputted by the source driver circuit C to the first data line D1. The XSTB waveform is a reverse polarity enabling signal; M represents the pixel voltage signal received or transmitted by the multiplexer M corresponding to each time sequence. Specifically, when the XSTB signal is enabled, both the first switch unit S1 and the second switch unit S2 are open (interrupting current); when the XSTB signal is disabled, the source driver circuit C outputs the pixel voltage to the first data line D1 through the first conductive wire F1 and the first switch unit S1, or to the second data line D2 through the second conductive wire F2 and the second switch unit S2.

As shown in FIG. 2G, when the XSTB signal is disabled for the first time, the source driver module Z enters the first data outputting period T1. As described in the step S100, when the source driver circuit C outputs the first voltage signal V1 during the first data outputting period T1, the first switch unit S1 is closed (conducting current) at the same time, thus the first voltage signal V1 can be transmitted to the first data line D1 through the multiplexer M.

Please refer to FIG. 2G again. When the XSTB signal is enabled for the second time, the first switch unit S1 is open (interrupting current), and the multiplexer M does not receive the voltage signal; when the XSTB signal is disabled for the second time, the source driver module Z enters the second data outputting period T2. At that time, as described in the step S102, the second switch unit S2 is closed (conducting current) and receives the second voltage signal V2 outputted by the source driver circuit C so as to enable the second data line D2 to receive the second voltage signal V2 through the multiplexer M.

After the second data outputting period T2 ends, the XSTB signal is enabled for the third time, and the source driver module Z enters the first switch-off period B1. Since the source driver circuit C outputs the second voltage signal V2 to the first data line D1 during the second data outputting period T2 after the first switch-off period B1, as shown in FIG. 2G, and the end of the first switch unit S1 adjacent to the first data line D1 still maintains the same voltage level as the first voltage signal V1 during the first switch-off period B1, for the purpose of avoiding charge sharing due to voltage difference between the two ends when the first switch unit S1 returns to a conducting state during the second data outputting period T2, the source driver circuit C outputs the first voltage signal V1 to the first conductive wire F1 during the first switch-off period B1 so that the voltage level of the first conductive wire F1 is the same as the voltage level of the first voltage signal V1 during the first switch-off period B1. Therefore, as shown in FIG. 2G, the source driver circuit C outputs the first voltage signal V1 during the first switch-off period B1. Since at this time the first switch unit S1 is still open (interrupting current), the multiplexer M has no input signal during this period, and the first voltage signal V1 outputted by the source driver circuit C will not be transmitted to the first data line D1 to avoid frequent signal input which results in noises in the panel.

In FIG. 2G, when the XSTB signal is disabled for the third time, the source driver module Z enters the second data outputting period T2. At that time, the source driver module Z outputs the second voltage signal V2. Since the first switch unit S1 is closed (conducting current) during the period, the voltage level of the multiplexer M is the same as the second voltage signal V2. The second voltage signal V2 is transmitted to the first data line D1 through the multiplexer M so that the first pixel P1 is charged by the second voltage signal V2.

Please refer to FIG. 2G again. After the second data outputting period T2, the first switch unit S1 is open (interrupting current), and the source driver module Z enters the second switch-off period B2. During the period, both the first switch unit S1 and the second switch unit S2 areopen, hence the multiplexer M has no input signal. Since the source driver module Z outputs the fourth voltage signal V4 to the second data line D2 during the fourth data outputting period T4 after the second switch-off period B2, and the end of the second switch unit S2 adjacent to the second data line D2 still maintains the same voltage level as the third voltage signal V3 during the second switch-off period B2, the present embodiment allows the source driver circuit C to output the third voltage signal V3 to the second conductive wire F2 during the second switch-off period B2 to avoid generating charge sharing due to the voltage difference between two ends of the switch when the second switch unit S2 is closed (conducting current) again during the fourth data outputting period T4 (as shown in FIG. 2G). At this time, the second switch unit S2 is still open, hence the multiplexer M has no input signal, and the third voltage signal V3 will not enter the display panel A so as not to generate noise interference.

In summary, the present embodiment allows the source driver circuit C to output the voltage of the precious pixel to the first conductive wire F1 or the second conductive wire F2 using the high impedance state between the source driver module Z and the display panel A during the pixel data outputting periods of the two data lines D1, D2 so as to avoid generating charge sharing due to voltage difference when the first switch unit S1 or the second switch unit S2 is closed so thatlikelihood of noise in the display panel A may be decreased.

It should be noted that the present embodiment uses the structure of one source driver circuit C driving two data lines D1, D2 as an example. However, the present embodiment is not limited thereto. In another embodiment, one source driver circuit C may also drive more than two data lines through a multiplexer. In addition, for the purpose of clearly indicating the technical ways used in the embodiment of the disclosure, the values of the first voltage signal V1 and the second voltage signal V2 outputted by the source driver circuit C to the first data line D1 are different, and the values of the third voltage signal V3 and the fourth voltage signal V4 outputted by the source driver circuit C to the second data line D2 are also different in the embodiment of FIG. 2G. However, in an actual application, the first voltage signal V1, the second voltage signal V2, the third voltage signal V3, and the fourth voltage signal V4 may be the same or different according to actual demands.

The Second Embodiment

Figure 3:
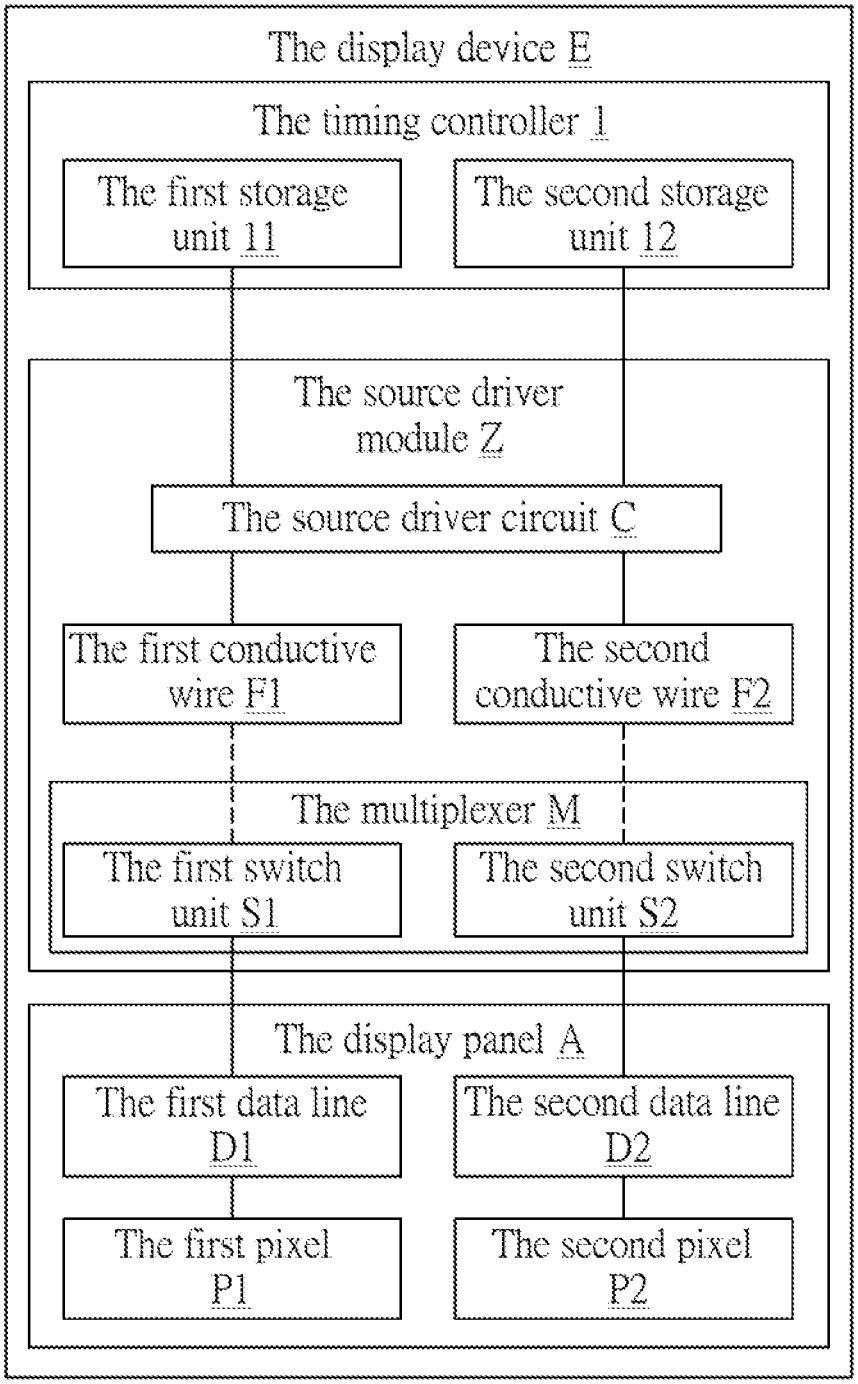
FIG. 3 is a functional diagram of the display device in the second embodiment of the present disclosure.

Please refer to FIG. 3, the second embodiment of the present disclosure provides a display device E which includes a timing controller 1, the source driver module Z and the display panel A. The source driver module Z and the display panel A in the present embodiment are approximately the same as the aforementioned embodiment. Therefore, the structures of the source driver module Z and the display panel A will not be described again. The main difference between the present embodiment and the first embodiment is as follows: the first embodiment merely indicates the signal outputting mode of the source driver module Z, while the present embodiment describes a device and a method to realize the signal outputting mode using a display device E and a display device driving method.

Specifically, as shown in FIG. 3, the timing controller 1 includes a first storage unit 11 and a second storage unit 12. Both the first storage unit 11 and the second storage unit 12 are electrically connected to the source driver circuit C. In the present embodiment, the first storage unit 11 and the second storage unit 12 are line buffers configured to output the pixel voltage signal to the source driver circuit C.

Figure 4:
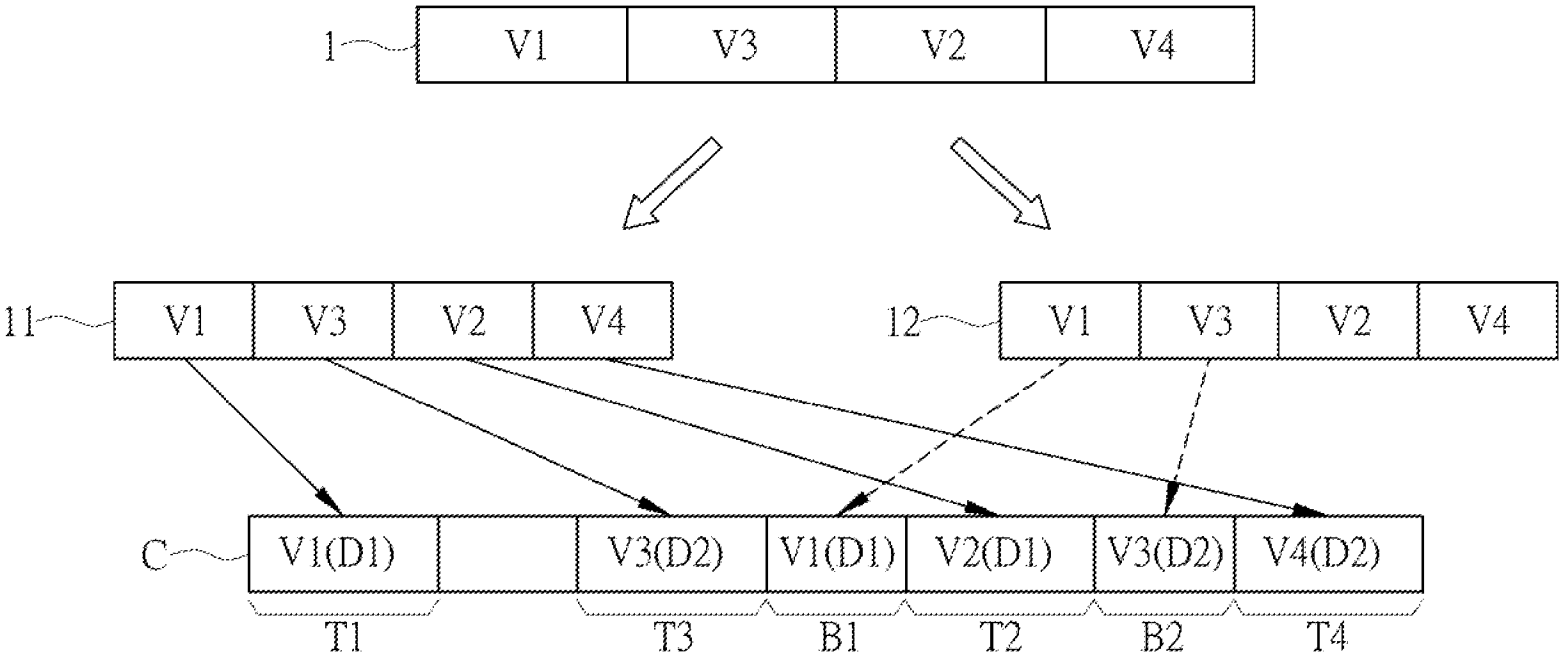
FIG. 4 is a diagram of the source driver circuit in the second embodiment of the present disclosure receiving pixel voltage from the first storage unit and the second storage unit.

Furthermore, as shown in FIG. 4, both of the first storage unit 11 and the second storage unit 12 store the first voltage signal V1, the second voltage signal V2, the third voltage signal V3, and the fourth voltage signal V4 in the present embodiment. The first storage unit 11 is configured to supply the pixel voltage signal outputted by the source driver circuit C to the first data line D1 or the second data line D2, and the second storage unit 12 is configured to supply the pixel voltage signal outputted to the first conductive wire F1 or the second conductive wire F2 when the source driver circuit C is at high impedance states B1, and B2.

Figure 5:
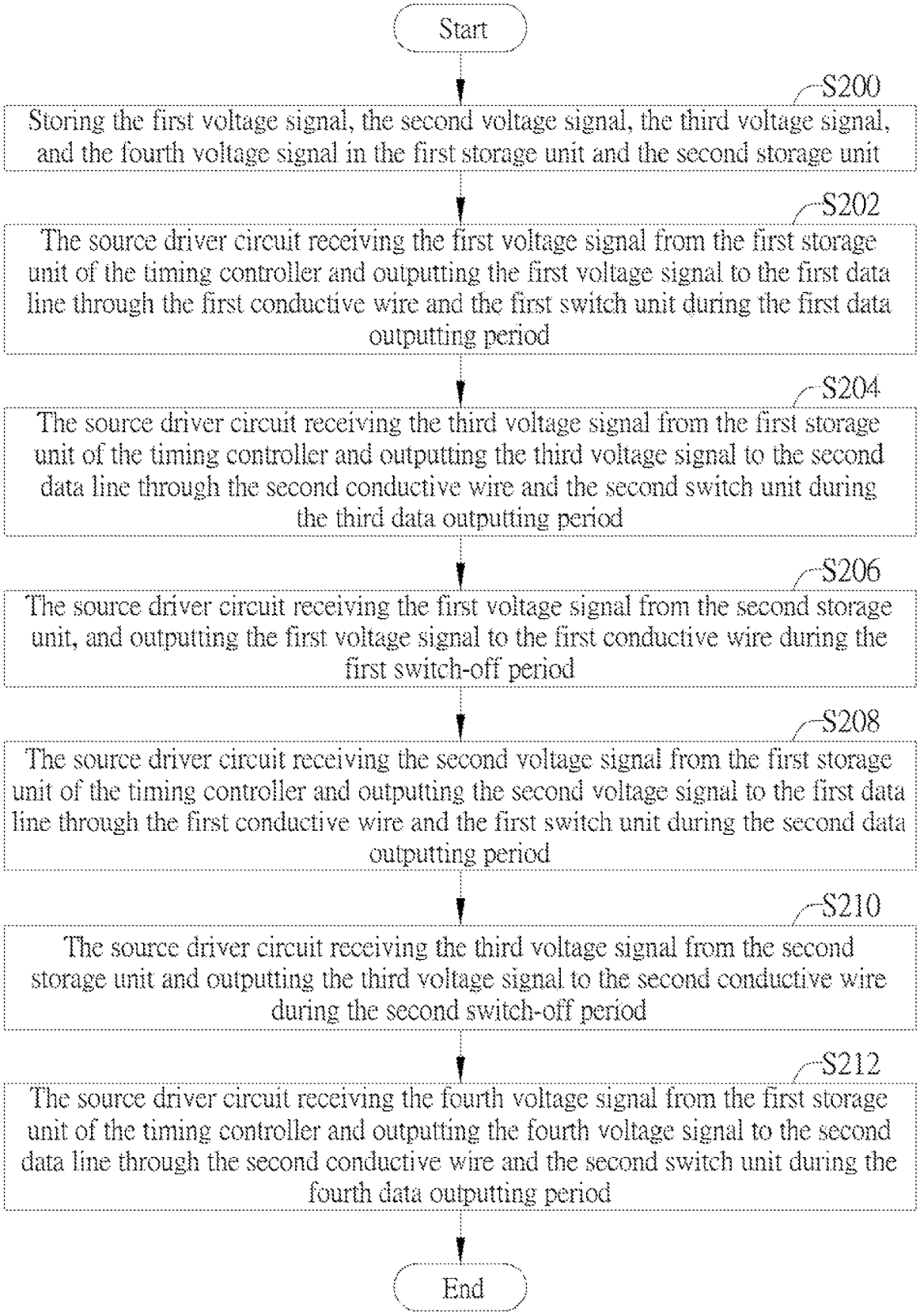
FIG. 5 is a flowchart of a method for driving the display in the second embodiment of the present disclosure.

In particular, please refer to FIG. 3, FIG. 4, and FIG. 5. The display device driving method according to the present disclosure at least includes the following steps. A step S200: storing the first voltage signal V1, the second voltage signal V2, the third voltage signal V3, and the fourth voltage signal V4 in the first storage unit 11 and the second storage unit 12. Specifically, as shown in FIG. 4, in the present embodiment, the timing controller 1 receives pixel data such as the first voltage signal V1, the second voltage signal V2, the third voltage signal V3, and the fourth voltage signal V4 at first so as to store the pixel data such as the first voltage signal V1, the second voltage signal V2, the third voltage signal V3, and the fourth voltage signal V4 in the first storage unit 11 and the second storage unit 12. The timing controller 1 may receive a plurality of pixel data, for example, through a data receiving unit. The first storage unit 11 and the second storage unit 12 also receive receive a plurality of pixel data through the data receiving unit; however, the present embodiment is not limited thereto.

Please refer to FIG. 3 to FIG. 5 again. After the step S200, the display device driving method provided by the present embodiment further includes: a step S202: the source driver circuit C receiving the first voltage signal V1 from the first storage unit 11 of the timing controller 1 and outputting the first voltage signal V1 to the first data line D1 through the first conductive wire F1 and the first switch unit S1 during the first data outputting period T1; a step S204: the source driver circuit C receiving the third voltage signal V3 from the first storage unit 11 of the timing controller 1 and outputting the third voltage signal V3 to the second data line D2 through the second conductive wire F2 and the second switch unit S2 during the third data outputting period T3; a step S206: the source driver circuit C receiving the first voltage signal V1 from the second storage unit 12, and outputting the first voltage signal V1 to the first conductive wire F1 during the first switch-off period B1. Thus, the voltage level of the first conductive wire F1 is the same as the voltage level of the first data line D1 when switching to the second data outputting period T2 from the first switch-off period B1.

Then, as shown in FIG. 3 to FIG. 5, after the first switch-off period B1, the display device driving method of the present embodiment implements the following steps. A step S208: the source driver circuit C receiving the second voltage signal V2 from the first storage unit 11 of the timing controller 1 and outputting the second voltage signal V2 to the first data line D1 through the first conductive wire F1 and the first switch unit S1 during the second data outputting period T2; a step S210: the source driver circuit C receiving the third voltage signal V3 from the second storage unit 12 and outputting the third voltage signal V3 to the second conductive wire F2 during the second switch-off period B2. Thus, the voltage level of the second conductive wire F2 is the same as the voltage level of the second data line D2 when switching to the fourth data outputting period T4 from the second switch-off period B2. Finally, in a step S212, the source driver circuit C receiving the fourth voltage signal V4 from the first storage unit 11 of the timing controller 1 and outputting the fourth voltage signal V4 to the second data line D2 through the second conductive wire F2 and the second switch unit S2 during the fourth data outputting period T4. It should be understood that in FIG. 4 and FIG. 5, the present embodiment merely illustrates the fourth data outputting period T4 in the time sequence to describe the technical features of the present embodiment; however, the present disclosure is not limited thereto. For example, in the present embodiment, the second storage unit 12 may provide the second voltage signal V2 to the source driver circuit C, and the source driver circuit C outputs the second voltage signal V2 to the first conductive wire F1 during a switch-off period between the fourth data outputting period T4 and a next data outputting period so that the first data line D1 and the first conductive wire F1 have the same voltage level when the source driver circuit C inputs the pixel data to the first data line D1 for the next time.

As mentioned in the aforementioned steps, the present embodiment firstly stores the same pixel voltage signal in the first storage unit 11 and the second storage unit 12. Then, the source driver circuit C receives the pixel voltage signal from the first storage unit 11 and outputs the pixel voltage signal to the corresponding data lines according to the predetermined time sequence, and the source driver circuit C receives the pixel voltage signal from the second storage unit 12 and outputs it to the first conductive wire F1 or the second conductive wire F2 during each of the high impedance period when the display device E outputs the image. Clearly speaking, every time the first switch unit S1 is closed to conduct current, the source driver circuit C outputs the pixel voltage signal which is the same as the first data line D1 to the first conductive wire F1 so that the two ends of the switch have the same voltage level when the first switch unit S1 isclosed; every time the second switch unit S2 is closed to conduct current, the source driver circuit C outputs the pixel voltage signal which is the same as the second data line D2 to the second conductive wire F2 so that two ends of the switch have the same voltage level when the second switch unit S2 is closed.

In summary, the source driver module Z, the display device E, the display panel driving method and the display device driving method provided by the embodiment of the present disclosure allow the first conductive wire F1 and the first data line D1 to have the same voltage level when switching to the second data outputting period T2 from the first switch-off period B1 through the technical measures of "outputting the first voltage signal V1 to the first data line D1 during the first data outputting period T1" and "outputting the first voltage signal V1 to the first conductive wire F1 during the first switch-off period B1 between the first data outputting period T1 and the second data outputting period T2".

The aforementioned description merely represents the preferred embodiment of the present disclosure, without any intention to limit the scope of the present disclosure. Various equivalent alternation based on the specification and FIGS. are consequently viewed as being embraced by the scope of the present disclosure.

What is claimed is:

1. A source driver module for driving a display panel, comprising:

a source driver circuit;

a first conductive wire electrically connected to the source driver circuit and configured to output signals of the source driver circuit; and a first switch unit connected between the first conductive wire and a first data line of the display panel, the first switch unit configured to conduct current therebetween during a first data outputting period and a second data outputting period after the first data outputting period and configured to interrupt current therebetween during a first switch-off period between the first data outputting period and the second data outputting period, wherein the source driver circuit is configured to output a first voltage signal to the first data line during the first data outputting period, to output a second voltage signal to the first data line during the second data outputting period, and outputting the first voltage signal to the first conductive wire during the first switch-off period.

2. The source driver module according to claim 1, further comprising:

a second conductive wire electrically connected to the source driver circuit and configured to output signals of the source driver circuit; and a second switch unit electrically connected between the second conductive wire and a second data line of the display panel, the second switch unit configured to conduct current between the source driver circuit and the second data line during a third data outputting period between the first data outputting period and the first switch-off period and during a fourth outputting period after the second data outputting period, and to interrupt current between the source driver circuit and the second data line during a second switch-off period between the second data outputting period and the fourth data outputting period, wherein the source driver circuit is configured to output a third voltage signal to the second data line through the second conductive wire and the second switch unit during the third data outputting period, to output a fourth voltage signal to the second data line through the second conductive wire and the second switch unit during the fourth data outputting period, and to output the third voltage signal to the second conductive wire during the second switch-off period.

3. The source driver module according to claim 2, further comprising: a multiplexer comprising the first switch unit and the second switch unit.

4. A display panel driving method for the source driver module according to claim 1, comprising:

outputting the first voltage signal to the first data line through the first conductive wire and the first switch unit by the source driver circuit during the first data outputting period; and outputting the first voltage signal to the first conductive wire by the source driver circuit during the first switch-off period, so that the first conductive wire and the first data line have the same voltage level when switching to the second data outputting period from the first switch-off period.

5. The display panel driving method according to claim 4, wherein the source driver module further comprises a second conductive wire electrically connected to the source driver circuit and a second switch unit electrically connected between the second conductive wire and a second data line of the display panel; the second switch unit is configured to conduct current between the source driver circuit and the second data line during a third data outputting period between the first data outputting period and the first switch-off period and during a fourth outputting period after the second data outputting period and to interrupt current between the source driver circuit and the second data line during a second switch-off period between the second data outputting period and the fourth data outputting period; the display panel driving method further comprises:

outputting a third voltage signal to the second data line through the second conductive wire and the second switch unit by the source driver circuit during the third data outputting period; and outputting the third voltage signal to the second conductive wire by the source driver circuit during a second switch-off period between the second data outputting period and the fourth data outputting period, so that the second conductive wire and the second data line have the same voltage level when switching to the fourth data outputting period from the second switch-off period.

6. A display device, comprising:

a display panel;

the source driver module according to claim 1; and a timing controller comprising a first storage unit and a second storage unit, the first storage unit and the second storage unit electrically connected to the source driver circuit, respectively, the first voltage signal and the second voltage signal stored in the first storage unit and the second storage unit, wherein the source driver circuit is configured to receive the first voltage signal from the first storage unit of the timing controller and to output the first voltage signal to the first data line through the first conductive wire and the first switch unit during the first data outputting period, configured to receive the first voltage signal from the second storage unit and to output the first voltage signal to the first conductive wire during the first switch-off period, and configured to receive the second voltage signal from the first storage unit of the timing controller and to output the second voltage signal to the first data line through the first conductive wire and the first switch unit during the second data outputting period.

7. The display device according to claim 6, wherein the source driver module further comprises a second conductive wire electrically connected to the source driver circuit and a second switch unit electrically connected between the second conductive wire and a second data line of the display panel; a third voltage signal and a fourth voltage signal are stored in the first storage unit and the second storage unit, wherein the source driver circuit is configured to receive the third voltage signal from the first storage unit of the timing controller and to output the third voltage signal to the second data line through the second conductive wire and the second switch unit during a third data outputting period between the first data outputting period and the first switch-off period, configured to receive the fourth voltage signal from the first storage unit of the timing controller and to output the fourth voltage signal to the second data line through the second conductive wire and the second switch unit during a fourth outputting period after the second data outputting period, and configured to receive the third voltage signal from the second storage unit and to output the third voltage signal to the second conductive wire during a second switch-off period between the second data outputting period and the fourth data outputting period.

8. A display device driving method for the display device according to claim 6, comprising:

storing the first voltage signal and the second voltage signal in the first storage unit and the second storage unit;

receiving the first voltage signal from the first storage unit of the timing controller and outputting the first voltage signal to the first data line through the first conductive wire and the first switch unit by the source driver circuit during the first data outputting period; and receiving the first voltage signal from the second storage unit by the source driver circuit during the first switch-off period, so that the first conductive wire and the first data line have the same voltage level when switching to the second data outputting period from the first switch-off period.

9. The display device driving method according to claim 8, wherein the source driver module further comprises a second conductive wire electrically connected to the source driver circuit and a second switch unit electrically connected between the source driver circuit and a second data line of the display panel, and the step of storing the first voltage signal and the second voltage signal in the first storage unit and the second storage unit further comprises:

storing a third voltage signal and a fourth voltage signal in the first storage unit and the second storage unit;

receiving the third voltage signal from the first storage unit of the timing controller and outputting the third voltage signal to the second data line through the second conductive wire and the second switch unit by the source driver circuit during a third data outputting period between the first data outputting period and the first switch-off period; and receiving the third voltage signal from the second storage unit and outputting the third voltage signal to the second conductive wire by the source driver circuit during a second switch-off period between the second data outputting period and a fourth data outputting period, so that the second conductive wire and the second data line have the same voltage level when switching to the fourth data outputting period from the second switch-off period.

* * * * *